US010280892B2

(12) United States Patent
Bleil et al.

(10) Patent No.: US 10,280,892 B2
(45) Date of Patent: May 7, 2019

(54) METHOD FOR CONTROLLING THE TEMPERATURE OF GLOW PLUGS

(71) Applicant: BorgWarner Ludwigsburg GmbH, Ludwigsburg (DE)

(72) Inventors: Andreas Bleil, Ludwigsburg (DE); Michael Eberhardt, Neckargemünd (DE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 0 days.

(21) Appl. No.: 15/962,621

(22) Filed: Apr. 25, 2018

(65) Prior Publication Data

US 2018/0313319 A1 Nov. 1, 2018

(30) Foreign Application Priority Data

Apr. 27, 2017 (DE) ..... 10 2017 109 071

(51) Int. Cl.
*F02P 19/02* (2006.01)
*F02P 17/12* (2006.01)

(52) U.S. Cl.
CPC ..... *F02P 19/023* (2013.01); *F02P 17/12* (2013.01); *F02P 19/025* (2013.01)

(58) Field of Classification Search
CPC ..... F02P 17/12; F02P 19/021; F02P 19/022; F02P 19/023; F02P 19/025
USPC ..... 123/145 A
See application file for complete search history.

(56) References Cited

U.S. PATENT DOCUMENTS

| | | | | |
|---|---|---|---|---|
| 9,322,383 | B2 * | 4/2016 | Sackmann | F23Q 7/00 |
| 2006/0049163 | A1 | 3/2006 | Gotoh et al. | |
| 2009/0289051 | A1 * | 11/2009 | Cassani | F02P 19/022 219/497 |
| 2010/0283489 | A1 * | 11/2010 | Kernwein | F02P 17/12 324/693 |
| 2010/0312416 | A1 * | 12/2010 | Demirdelen | F02P 19/025 700/300 |
| 2011/0127250 | A1 * | 6/2011 | Rapp | F23Q 7/001 219/260 |
| 2014/0054279 | A1 | 2/2014 | Joos et al. | |

FOREIGN PATENT DOCUMENTS

| | | | |
|---|---|---|---|
| DE | 10 2011 004 514 A1 | | 8/2012 |
| WO | WO 2013-054598 | * | 4/2018 |

* cited by examiner

*Primary Examiner* — Erick R Solis
(74) *Attorney, Agent, or Firm* — Bose McKinney & Evans LLP

(57) ABSTRACT

A method for controlling the temperature of glow plugs of a combustion engine is described, wherein all glow plugs are heated up for an engine start by the input of electrical energy according to a profile which is uniformly specified for all glow plugs of the engine, a change in resistance ΔR is ascertained for each of the glow plugs for at least one specified time span, and a target resistance value is calculated for each glow plug from the associated change in resistance ΔR, this value being expected for the glow plug when it has reached its target temperature, and the target resistance value is used to control the temperature of the glow plug to the target temperature.

10 Claims, 2 Drawing Sheets

METHOD FOR CONTROLLING THE TEMPERATURE OF GLOW PLUGS

RELATED APPLICATIONS

This application claims priority to DE 10 2017 109 071.1, filed Apr. 27, 2017, the entire disclosure of which is hereby incorporated herein by reference.

BACKGROUND

The invention relates to a method for controlling the temperature of glow plugs of a combustion engine.

Various methods have been disclosed in the prior art for controlling glow plugs to a target temperature, for example in DE 10 2112 192 013 A1 and DE 10 2006 060 632 A1. A general problem associated with controlling the temperature of glow plugs consists in that the electrical resistance of glow plugs, especially of ceramic glow plugs, is subject to major fluctuations due to manufacturing tolerances. And since inaccuracies in the resistance temperature characteristic used lead to corresponding inaccuracies in the temperature control, it is desirable to obtain most accurate knowledge of the electrical resistance of a glow plug at a target temperature.

One option for determining the resistance temperature characteristic of a glow plug consists in keeping the engine at standstill for a few minutes and then heating the glow plug for a certain period of time, e.g. for approx. one minute using a constant amount of specified electrical power until the glow plug has reached a state of equilibrium, the temperature of which is defined by the heat output and the heat dissipation with the engine at standstill and is therefore known or can be ascertained for all future cases by way of measuring. This way of proceeding however has the disadvantage of being very expensive.

SUMMARY

This disclosure teaches how the electrical resistance associated with a target temperature can be determined very quickly for a method of controlling the temperature of a glow plug.

With a method according to this disclosure, when the engine is to be started, all glow plugs are heated up by inputting electrical energy according to a profile uniformly specified for all glow plugs of the engine. This profile is preferably a power profile, that is, it specifies the time-related progression of the power fed into the plug. Alternatively, the profile may be a current profile or a voltage profile.

When inputting the electrical energy according to a chosen profile a change in resistance is measured for each of the glow plugs and a target resistance value is calculated from this change in resistance and a target temperature value. The target resistance value is the value expected for the glow plug when it is at its target temperature. The target resistance value is then used to control the temperature of the glow plug to this target operating temperature, e.g. by means of a PID method. The method according to this disclosure is suited in particular for ceramic glow plugs.

An important advantage of the method according to this disclosure is that the target resistance value necessary for operation is ascertained while the glow plug is heated for an engine start, which means that no additional time is required. Moreover the target resistance value is re-ascertained for each engine start so that a possible change of glow plugs or aging-related change in the glow plugs does not present a problem.

The electrical resistances of ceramic glow plugs vary widely due to manufacturing tolerances. Hence, applying a uniform voltage to all glow plugs of a motor is not ideal. By applying a uniform heating profile, in particular a uniform power profile to individual glow plugs, the impact of different resistance temperature characteristics on the heating-up behaviour of the glow plugs can be eliminated. As part of this disclosure it was found that the resistance associated with a target temperature can be calculated from one or more values of the change in resistance during heating-up of the glow plug. Preferably this is done using an empirical formula, which defines a linear dependency of the target resistance value on the value of the change in resistance, or in other words, where the target resistance value is proportional to the change in resistance. The following equation is well suited for calculating the target resistance value $R_{Soll}$ as a function of a change in resistance $\Delta R$:

$$R_{Soll}=a\cdot\Delta R+b,$$

wherein a and b are parameters which are empirically ascertained, for example by the manufacturer, for a target temperature of a model series of glow plugs, and which can be stored for the respective glow plug type in a glow plug control unit which carries out the method according to the invention. The temporal derivation of the resistance can be used as the change in resistance $\Delta R$.

The electrical profile which is fed to the glow plugs for heating up for an engine start may be constant for the entire heating period, i.e., may provide constant power in the case of a power profile or may comprise several constant stages. Preferably, when heating up a glow plug to its operating temperature for an engine start, the power profile used is one which alters the electrical power during the heating-up process, for example lowers it in steps according to pre-set time spans. Best suited are, in particular, power profiles which continually reduce electrical power during the heating-up process. The electrical power profile can for example be chosen such that an approximately linear change in resistance occurs within a pre-set time span. The target resistance value expected for the glow plug at its target temperature is then preferably calculated by measuring the change in resistance for such a pre-set time span, in which due to the pre-set power profile an approximately constant change in resistance per time unit occurs.

An advantageous further refinement of this disclosure provides for the change in resistance to be ascertained from measured values which are measured during the first 800 ms after the start of heating up. This has the advantage that the resistance values obtained are not affected by the start of the engine operation such as by the injection of fuel.

Another advantageous further refinement of this disclosure provides for a value for the change in resistance to be obtained for each glow plug over several time intervals. These values may individually be included in the calculation of the target resistance value expected for the glow plug, when this has reached its target temperature. Preferably, however, a total value is ascertained from several values of the change in resistance, which is then used for the calculation of the target resistance value expected for the glow plug, when this has reached its target temperature. For it was found as part of this disclosure that the change in resistance at the start of the heating-up process is approximately constant. By averaging a number of resistance change values measured at the start of the heating-up process, for example during the first 800 ms, a more precise value for the change in resistance can therefore be obtained, for example the temporal derivation of the resistance. Individual time intervals may be adjacent to one another or overlap. The use of overlapping time intervals has the advantage that an average value is calculated from a larger number of resistance change values in a limited measuring window thereby improving accuracy.

The measuring window, respectively the individual time intervals or time durations, may each be defined by an explicit timing. If the profile is a power profile, this is synonymous with a pre-set energy input. If the profile is a current profile or a voltage profile this is, however, not the case. Therefore an advantageous option consists in defining measuring windows, time durations and/or time intervals by an amount of energy so that the end of the measuring window, the time duration/the respective time interval is reached, when the pre-set amount of electrical energy has been fed into the glow plug.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

Figure 1:
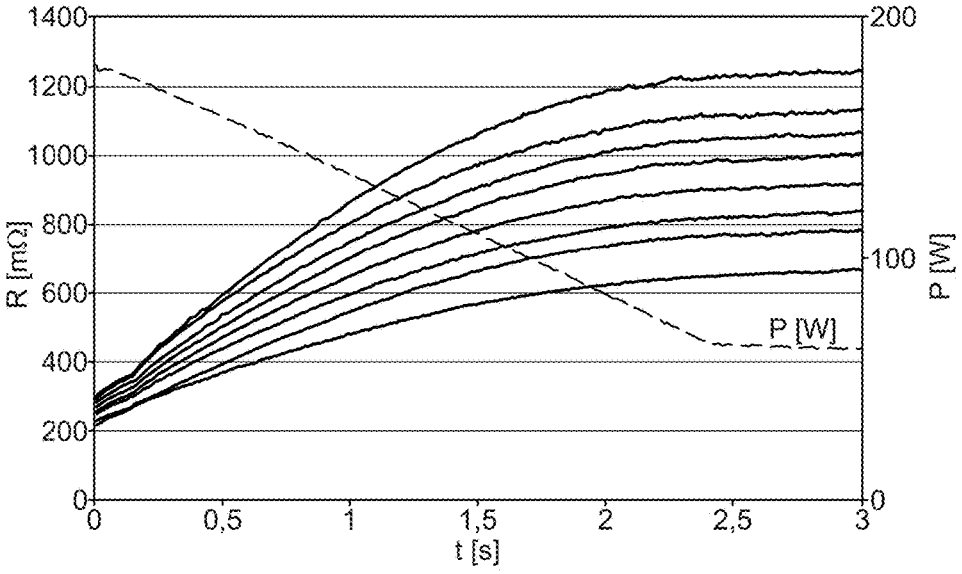
FIG. 1 shows the resistance R of different ceramic glow plugs as a function of time during heating up with a power profile which is uniform for all glow plugs and indicated by the line provided with an arrow.

FIG. 1 shows the resistance R in mΩ as a function of time during heating-up with a power profile which is uniformly specified for all glow plugs. The power profile as a function of time is also shown in FIG. 1 by a line, which is associated with an arrow pointing towards the right ordinate axis on which the power P is given in watts. The power fed into the glow plugs according to this power profile is diminishing in monotonous fashion. In the embodiment shown the power profile can be divided roughly into three sections in which the applied power drops linearly at different rates. Heating-up of the glow plugs may also be effected using alternative power profiles, for example power profiles where the power is changed in steps and remains constant over an extended period of time.

Figure 2:
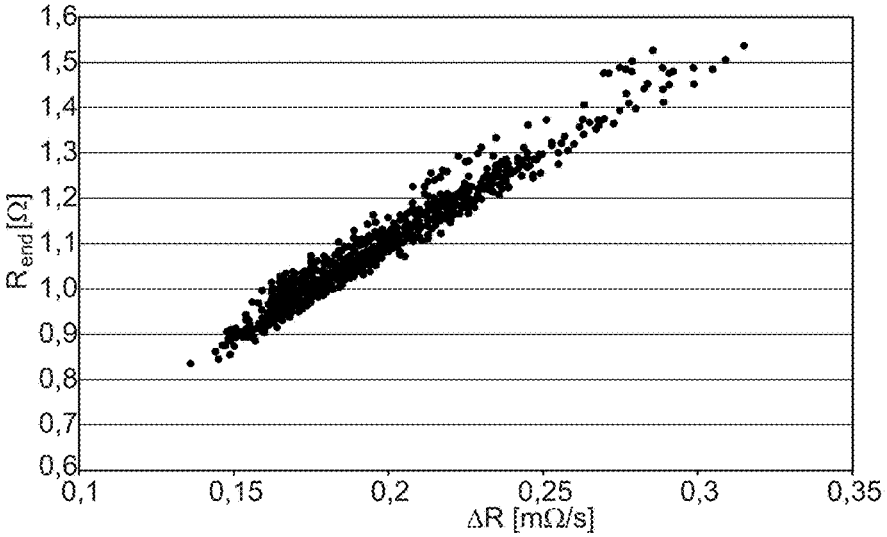
FIG. 2 shows the resistance $R_{end}$ reached by different ceramic glow plugs at the end of the heating-up process versus the change in resistance ΔR during the heating-up process.

Independently of the power profile used there is an approximately linear correlation between the resistance $R_{end}$ obtained at the end of the heating-up process and the change in resistance ΔR during the heating-up process or a specified part of the heating-up period. These facts are schematically shown in FIG. 2, in which the resistance $R_{end}$ in Ω reached at the end of the heating-up process is plotted versus the change in resistance ΔR in mΩ/s. FIG. 2 thus shows that there is a linear correlation between a change in resistance ΔR which occurs during heating-up of a glow plug for an engine start in a pre-set time interval and the resistance $R_{end}$ of the glow plug at the end of a heating-up process, i.e., the resistance at its target temperature.

By heating-up all glow plugs of an engine for an engine start by the input of an electrical power profile uniformly specified for all glow plugs of the engine and ascertaining a change in resistance ΔR for each of the glow plugs for at least one specified time span, a target resistance value can thus be calculated from the change in resistance ΔR, which is expected for each glow plug when it has reached its target temperature. The target resistance value calculated in this way can therefore be used for controlling the temperature of the glow plug to the target temperature.

Figure 3:
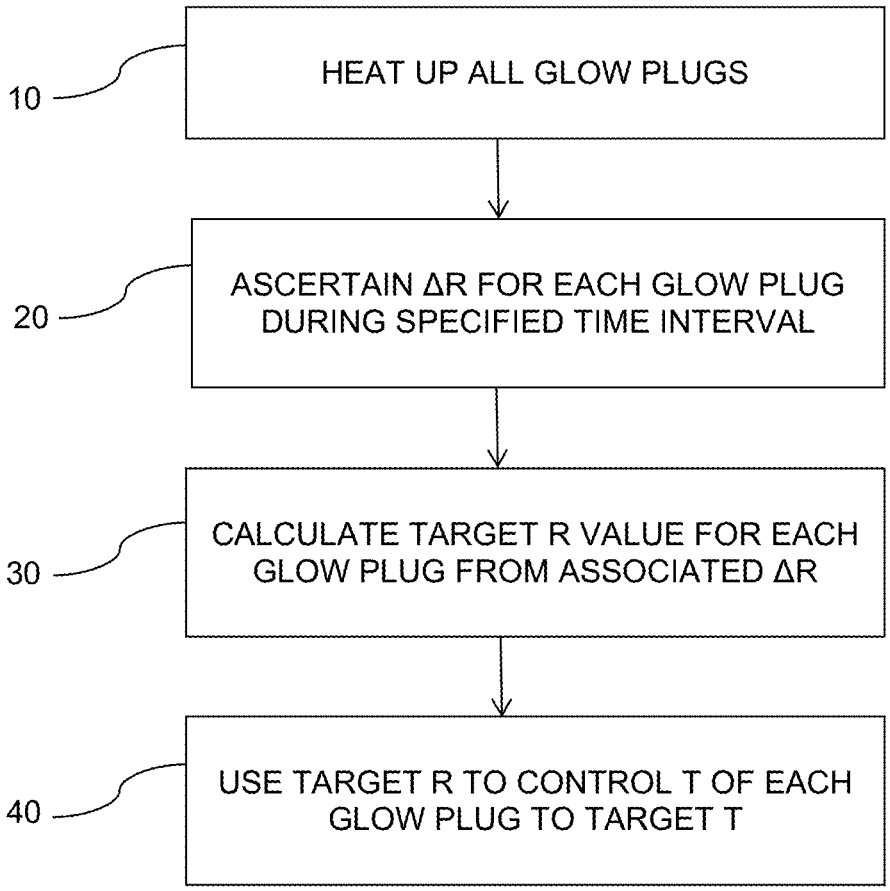
FIG. 3 is a flowchart illustrating the steps involved in an exemplary method of controlling the temperature of glow plugs in accordance with this disclosure.

FIG. 3 illustrates an exemplary embodiment of an exemplary method in accordance with this disclosure. In step 10, all glow plugs of the combustion engine are heated up by inputting electrical energy according to a profile which is uniformly specified for all glow plugs of the engine. In step 20, a change of resistance, ΔR, for each of the glow plugs is ascertained during a specified time interval. As already noted above, ΔR can occur during heating up of a glow plug. In step 30, a target resistance is calculated for each glow plug from the associated change in resistance, ΔR, and the target resistance value is a value that is expected for the respective glow plug when a target temperature is reached. Finally, in step 40, for each glow plug, the target resistance value is used to control the temperature of the glow plug to the target temperature.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

What is claimed is:

1. A method for controlling the temperature of glow plugs of a combustion engine, comprising:

heating up all glow plugs of the combustion engine for an engine start by inputting electrical energy according to a profile which is uniformly specified for all of the glow plugs of the engine;

ascertaining a change in resistance ΔR for each of the glow plugs during at least one specified time interval; and calculating a target resistance value for each glow plug from the associated change in resistance ΔR, the target resistance value being a value that is expected for the respective glow plug when a target temperature is reached; and for each glow plug, using the target resistance value to control the temperature of the glow plug to the target temperature.

2. The method according to claim 1, wherein the change in resistance ΔR is ascertained from measured values which are measured within a time span in which the engine has not yet been started.

3. The method according to claim 1, wherein the change in resistance ΔR is ascertained from measured values which are measured during the first 800 milliseconds after the start of heating up.

4. The method according to claim 1, wherein the target resistance value is calculated using a formula in which the target resistance value is assumed to be proportional to the change in resistance ΔR.

5. The method according to claim 1, wherein the profile is a power profile.

6. The method according to claim 1, wherein a value for the change in resistance ΔR is ascertained for each glow plug for several time intervals.

7. The method according to claim 6, wherein the power profile is chosen to result in an approximately linear change in resistance ΔR of the glow plug.

8. The method according to claim 6, wherein a total value is obtained from the several time intervals.

9. The method according to claim 6, wherein the time intervals lie within the first 800 milliseconds after the start of the heating-up process.

10. The method according to claim 6, wherein the time intervals overlap.

* * * * *